US009775759B2

(12) United States Patent
Davidson et al.

(10) Patent No.: US 9,775,759 B2
(45) Date of Patent: Oct. 3, 2017

(54) CHAIR FOR USE WITH OPHTHALMIC INSTRUMENTS

(71) Applicant: ACUITY OPHTHALMICS, LLC, Fenton, MO (US)

(72) Inventors: Brent Ryan Davidson, St. Louis, MO (US); Michael Claude Dayton, Sr., St. Louis, MO (US)

(73) Assignee: ACUITY OPHTHALMICS, LLC, Fenton, MO (US)

( * ) Notice: Subject to any disclaimer, the term of this patent is extended or adjusted under 35 U.S.C. 154(b) by 0 days.

(21) Appl. No.: 14/154,315

(22) Filed: Jan. 14, 2014

(65) Prior Publication Data

US 2015/0196448 A1 Jul. 16, 2015

(51) Int. Cl.

| | |
|---|---|
| ***A61G 15/00*** | (2006.01) |
| ***A47C 3/30*** | (2006.01) |
| ***A47C 7/00*** | (2006.01) |

(52) U.S. Cl.

CPC ..... *A61G 15/00* (2013.01); *A47C 3/30* (2013.01); *A47C 7/004* (2013.01); *A47C 7/006* (2013.01); *Y10T 29/49826* (2015.01)

(58) Field of Classification Search

CPC .... A47C 3/12; A47C 7/54; A47C 3/30; A47C 7/004; A47C 7/006; A61G 15/00; Y10T 29/49826

USPC ..... 297/338, 411.44, 183.6, 183.1, 451.1, 297/451.4, 188.1

See application file for complete search history.

(56) References Cited

U.S. PATENT DOCUMENTS

| | | | | | |
|---|---|---|---|---|---|
| 2,845,992 | A | * | 8/1958 | Cramer | 297/303.5 |
| D184,189 | S | * | 12/1958 | McCarthy | D6/366 |
| 2,938,575 | A | * | 5/1960 | Molla | 297/447.4 |
| 2,942,654 | A | * | 6/1960 | Hamilton | 297/411.44 |
| 3,114,577 | A | * | 12/1963 | Propst | 297/451.1 |
| 4,073,539 | A | * | 2/1978 | Caruso | 297/452.14 |
| 4,767,160 | A | * | 8/1988 | Mengshoel | A47C 7/52 248/188.7 |
| 4,892,356 | A | * | 1/1990 | Pittman et al. | 297/452.15 |
| 5,114,212 | A | * | 5/1992 | Verney et al. | 297/411.33 |
| D336,722 | S | * | 6/1993 | Fahnstrom et al. | D6/366 |
| D353,268 | S | * | 12/1994 | Ambasz | D6/366 |
| D363,383 | S | * | 10/1995 | Cronk | D6/366 |
| 5,547,253 | A | * | 8/1996 | Schwartz et al. | 297/338 |
| 5,810,438 | A | * | 9/1998 | Newhouse | 297/286 |
| D429,584 | S | * | 8/2000 | Brettschneider et al. | D6/716 |
| 6,279,998 | B1 | * | 8/2001 | Chu et al. | 297/440.22 |
| 6,655,731 | B2 | * | 12/2003 | Martin | 297/23 |
| D484,711 | S | * | 1/2004 | Getzel | D6/366 |
| 7,052,083 | B2 | * | 5/2006 | Peitz et al. | 297/183.1 |
| 7,147,286 | B2 | * | 12/2006 | Cesaroni et al. | 297/301.1 |
| D543,736 | S | * | 6/2007 | Shields | D6/716 |

(Continued)

FOREIGN PATENT DOCUMENTS

| | | | | | |
|---|---|---|---|---|---|
| GB | 1383362 | A | * | 2/1975 | A47C 3/12 |

*Primary Examiner* — Milton Nelson, Jr.

(74) *Attorney, Agent, or Firm* — Armstrong Teasdale LLP

(57) ABSTRACT

A chair includes a base, a seat coupled to the base, and a back coupled to the seat and/or the base. The seat includes a front portion positioned on a first side of the base, and a rear portion positioned on a second side of the base. A seat angle defined between the front portion and the base is substantially fixed between approximately 85 degrees and approximately 90 degrees. The back extends generally upward from the rear portion of the seat.

17 Claims, 2 Drawing Sheets

(56) References Cited

U.S. PATENT DOCUMENTS

| | | | | |
|---|---|---|---|---|
| 7,306,289 | B2 | 12/2007 | Kobayashi | |
| D576,812 | S * | 9/2008 | Van Severen | D6/366 |
| D622,986 | S * | 9/2010 | Kubryk | D6/716 |
| 8,061,775 | B2 | 11/2011 | Diffrient | |
| D657,581 | S * | 4/2012 | Lievore et al. | D6/366 |
| 8,272,692 | B1 | 9/2012 | Epperson | |
| 8,876,209 | B2 * | 11/2014 | Peterson et al. | 297/284.1 |
| 2005/0146184 | A1 | 7/2005 | Machael et al. | |
| 2007/0170768 | A1 * | 7/2007 | Hung | 297/411.44 |
| 2008/0136238 | A1 * | 6/2008 | Hill et al. | 297/338 |
| 2008/0164745 | A1 * | 7/2008 | Nichols | A47C 3/16<br>297/452.48 |
| 2008/0211277 | A1 | 9/2008 | Goetz et al. | |
| 2013/0113254 | A1 * | 5/2013 | Augustat | A47C 3/20<br>297/313 |
| 2014/0125093 | A1 * | 5/2014 | Kassanoff et al. | 297/183.1 |

* cited by examiner

CHAIR FOR USE WITH OPHTHALMIC INSTRUMENTS

BACKGROUND

The field of the disclosure relates generally to furniture, and more specifically, to a chair for use with an ophthalmic instrument.

Some known chairs are used to support a seated user during an ophthalmic observation. More specifically, during ophthalmic observation, the user leans forward to peer into an ophthalmic instrument. Leaning forward in a known chair may induce stresses in the body including, without limitation, in the user's head, neck, back, buttocks, and/or legs. During at least some ophthalmic observations, the user may be required to maintain the same position on the chair for an extended period of time. At least some known chairs are not sized and/or configured to comfortably accommodate the user in the same position for an extended period of time during the ophthalmic observation. Many users including obese, elderly, and/or handicapped users have difficulty maintaining the same position and, thus, are asked to adjust (e.g., sit up, lean forward, or position a pillow behind the user's back) to return to the original position.

BRIEF SUMMARY

In one aspect, a chair is provided. The chair includes a base, a seat coupled to the base, and a back coupled to the seat and/or the base. The seat includes a front portion positioned on a first side of the base, and a rear portion positioned on a second side of the base. A seat angle defined between the front portion and the base is substantially fixed between approximately 85 degrees and approximately 90 degrees. The back extends generally upward from the rear portion of the seat.

In another aspect, a method is provided for assembling a chair. The method includes coupling a seat to a base, such that a front portion of the seat is positioned on a first side of the base, and a rear portion of the seat is positioned on a second side of the base. A seat angle defined between the front portion and the base is substantially fixed between approximately 85 degrees and approximately 90 degrees. The method further includes coupling a back to the seat and/or the base. The back extends generally upward from the rear portion of the seat.

The features, functions, and advantages may be achieved independently in various implementations of the present disclosure or may be combined in yet other implementations, further details of which may be seen with reference to the following description and drawings.

Although specific features of various implementations may be shown in some drawings and not in others, this is for convenience only. Any feature of any drawing may be referenced and/or claimed in combination with any feature of any other drawing.

DETAILED DESCRIPTION

The field of the disclosure relates generally to furniture, and more specifically, to a chair for use with an ophthalmic instrument. Although the implementations described herein are described in conjunction with an ophthalmic and/or medical context, the implementations described herein may also be used for any application in any environment that enables the systems and methods to function and/or operate as described herein. In one implementation, a chair includes a base, a seat coupled to the base, and a back coupled to the seat and/or the base. A front portion of the seat and the base define a seat angle therebetween that is between approximately 85 and approximately 90 degrees. Accordingly, the chair described herein enables a user to be positioned in a neutral position and/or comfortably maintain the neutral position during ophthalmic observation. Moreover, the chair described herein enable a second user (e.g., a technician) to adjust a position of the user while the user is sitting in the chair.

As used herein, an element or step recited in the singular and preceded with the word "a" or "an" should be understood as not excluding plural elements or steps unless such exclusion is explicitly recited. Moreover, references to "one implementation" or "some implementations" are not intended to be interpreted as excluding the existence of additional implementations that also incorporate the recited features.

Figure 1:
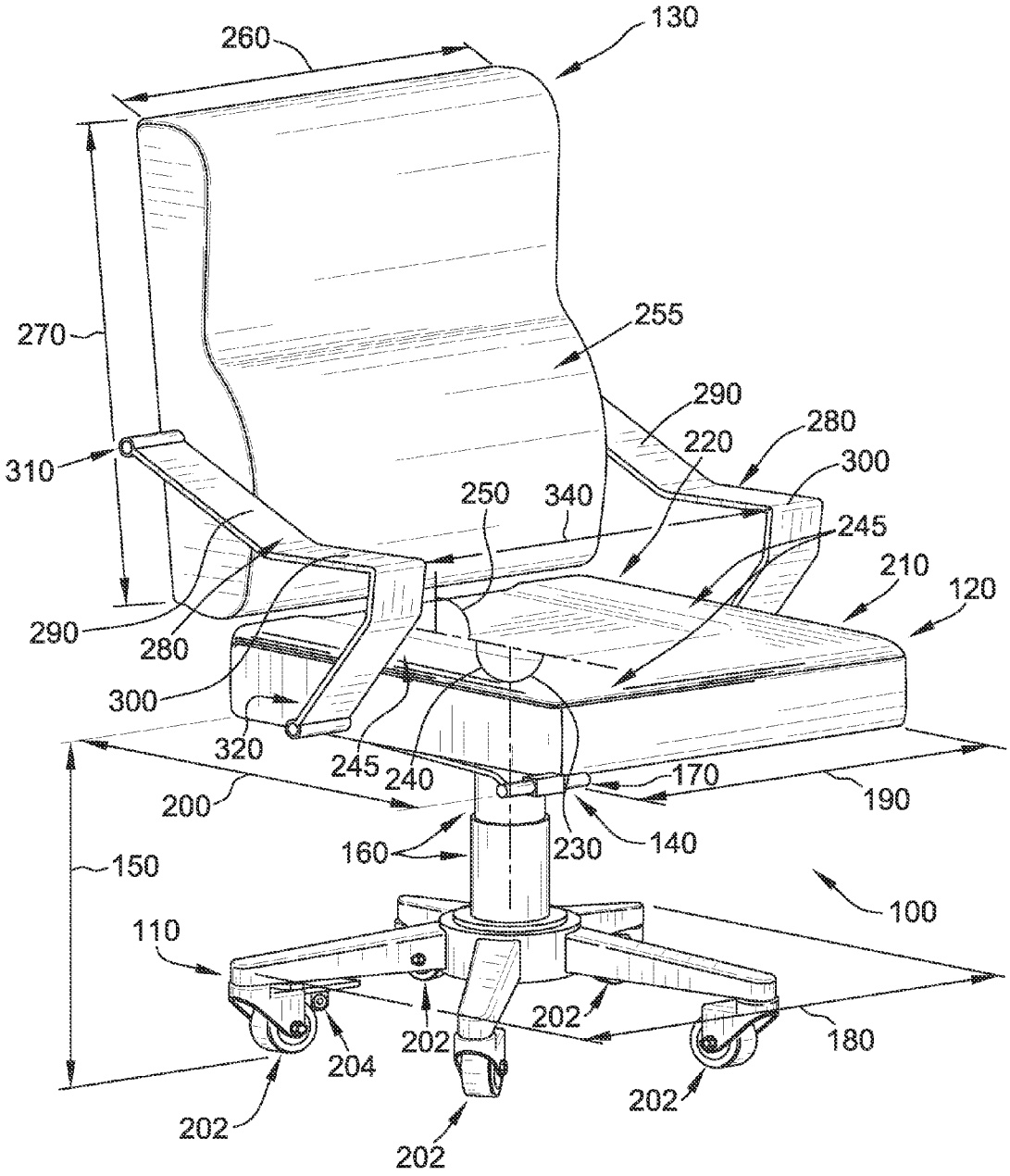
FIGS. 1 and 2 are each schematic illustrations of an exemplary chair for use with ophthalmic instruments.
Figure 2:
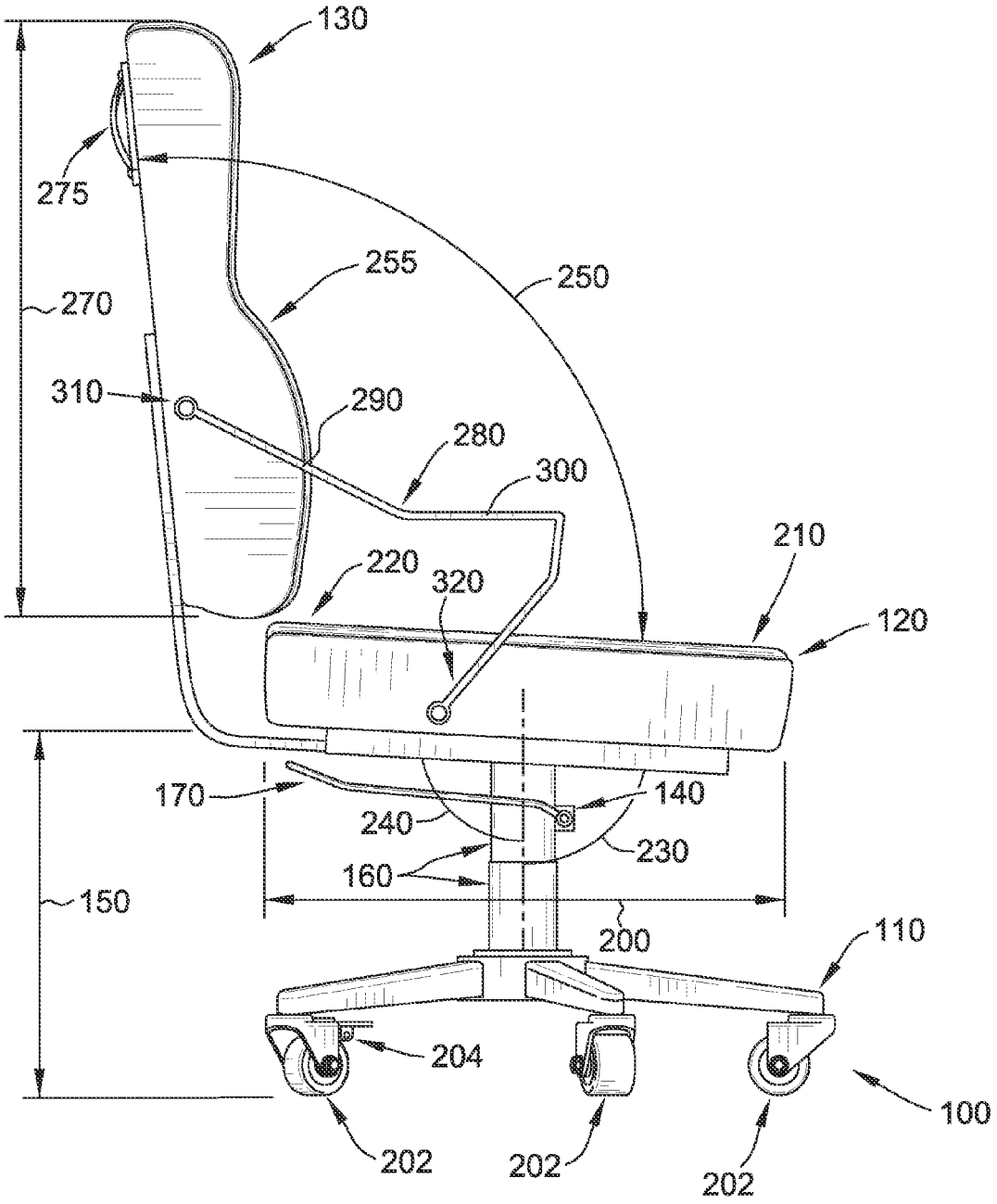

FIGS. 1 and 2 are schematic illustrations of an exemplary chair 100 for use with ophthalmic instruments (not shown). In some implementations, chair 100 includes a base 110, a seat 120 coupled to base 110, and a back 130 coupled to seat 120 and/or base 110. In some implementations, seat 120 and/or back 130 is at least partially fabricated from a tight-grained material and/or any other material that enables seat 120 and/or back 130 to be quickly and easily cleaned or sanitized between users.

In some implementations, base 110 includes an adjusting mechanism 140 that is configured to adjust a height 150 of seat 120. In some implementations, base 110 includes a plurality of telescoping cylinders 160, and adjusting mechanism 140 includes a lever 170 that is configured to and/or slide cylinders 160 to facilitate increasing and/or decreasing height 150. For example, in at least some implementations, adjusting mechanism 140 includes and/or is coupled to a hydraulic pump that enables a user (e.g., a technician) to raise and/or lower seat 120 while another user (e.g., a patient) is in seat 120. The hydraulic pump also enables raising seat 120 to facilitate moving a user towards a standing position. Alternatively, adjusting mechanism 140 may include any system and/or device that enables chair 100 to function as described herein.

In some implementations, base 110 has a base span 180 (shown in FIG. 1) that is wider or greater than a width 190 (shown in FIG. 1) of seat 120. In some implementations, width 190 is approximately 10% wider or greater than base span 180 (i.e., width 190 is approximately 110% of base span 180). For example, in at least some implementations, base span 180 is between approximately 20.6 inches and 28.1 inches, and width 190 is between approximately 22.7 inches and approximately 30.9 inches. More specifically, in at least one implementation, base span 180 is approximately 25.5 inches, and width 190 is approximately 28.0 inches. Base 110 has any base span 180 and/or seat 120 has any width 190 that enables chair 100 to function as described herein.

In some implementations, width 190 is longer or greater than a depth 200 of seat 120. In some implementations, width 190 is between approximately 40% and approximately 55% wider or greater than depth 200 (i.e., width 190 is between approximately 140% and approximately 155% of depth 200). For example, in at least some implementations, depth 200 is between approximately 16.2 inches and approximately 19.9 inches, and width 190 is between approximately 22.7 inches and approximately 30.9 inches. More specifically, in at least one implementation, depth 200 is approximately 18.0 inches, and width 190 is approximately 25.5 inches. Seat 120 has any width 190 and/or depth 200 that enables chair 100 to function as described herein.

In some implementations, base 110 includes and/or is coupled to casters 202 that enable chair 110 to be moved between a first position and a second, desired position. In at least some implementations, casters 202 are sized such that chair 110 is easily movable across tiled floors and low-pile carpet. In at least some implementations, at least one caster 202 includes and/or is coupled to a lock 204, such that caster 120 is lockable. In one implementation, lock 204 is configured and/or sized to be easily movable between an unlocked and a locked configuration with a hand and/or a foot, and/or is easily observable whether lock 204 is in the unlocked or the locked configuration.

In some implementations, seat 120 includes a front portion 210 positioned on a first side (i.e., the front) of base 110, and a rear portion 220 positioned on a second side (i.e., the rear) of base 110. In some implementations, seat 120 slopes downward towards front portion 210 and/or slopes upward towards rear portion 220. That is, in at least some implementations, seat 120 is sloped to enable a user to lean forward and/or comfortably maintain a neutral position during ophthalmic observation.

In some implementations, front portion 210 and base 110 define a first seat angle 230 therebetween that is substantially fixed between approximately 85 degrees and approximately 90 degrees. More specifically, in at least some implementations, first seat angle 230 is substantially fixed between approximately 86 degrees and approximately 88 degrees. Even more specifically, in at least one implementation, first seat angle 230 is substantially fixed at approximately 87 degrees. That is, in at least some implementations, first seat angle 230 is not adjustable. First seat angle 230 may be positioned in any orientation and/or configuration that enables chair 100 to function as described herein. Rear portion 220 and base 110 define a second seat angle 240 therebetween that is supplementary to first seat angle 230. Accordingly, in at least some implementations, seat angle 240 is not adjustable. Second seat angle 240 may be positioned in any orientation and/or configuration that enables chair 100 to function as described herein.

In some implementations, seat 120 is contoured and/or includes at least one raised portion 245 (e.g., a ridge, shown in FIG. 1) that provides at least some support to a user (e.g., a patient) while the user is on seat 120. For example, in at least one implementation, the contour and/or ridge enables the user to feel secure in seat 120 and/or facilitates preventing the user from sliding out of seat 120 during ophthalmic observation. In the exemplary embodiment, raise portion 245 extends along the front, left, and ride sides of an upper face of seat 120.

In some implementations, back 130 extends generally upward from rear portion 220 of seat 120. In at least some implementations, back 130 extends generally upward from rear portion 220 to enable a user to comfortably maintain a neutral position during ophthalmic observation. In some implementations, back 130 and seat 120 define a back angle 250 therebetween that is substantially fixed between approximately 90 degrees and approximately 98 degrees. More specifically, in at least some implementations, back angle 250 is substantially fixed between approximately 92 and approximately 97 degrees. Even more specifically, in at least one implementation, back angle 250 is substantially fixed at approximately 96 degrees. That is, in at least some implementations, back angle 250 is not adjustable. Back angle 250 may be positioned in any orientation and/or configuration that enables chair 100 to function as described herein.

In some implementations, back 130 is contoured and/or includes at least one raised portion 255 (e.g., a ridge) that provides at least some lumbar support to a user (e.g., a patient) while the user is on seat 120. In the exemplary embodiment, raised portion 255 extends across a middle portion of back 130.

In some implementations, a width 260 (shown in FIG. 1) of back 130 is longer or greater than a height 270 of back 130. In some implementations, width 260 is between approximately 10% and approximately 15% wider or greater than height 270 (i.e., width 260 is between approximately 110% and approximately 115% of height 270). For example, in at least some implementations, height 270 is between approximately 20.6 inches and approximately 26.8 inches, and width 260 is between approximately 22.7 inches and approximately 30.9 inches. More specifically, in at least one implementation, height 270 is approximately 22.9 inches, and width 260 is approximately 25.5 inches. In some implementations, width 260 is substantially similar to width 190 of seat 120. Back 130 has any width 260 and/or height 270 that enables chair 100 to function as described herein.

In at least some implementations, back 130 includes and/or is coupled to an articulating headrest (not shown) that facilitates retaining and/or stabilizing a user's head while the user is on seat 120.

In at least some implementations, at least one handle 275 (shown in FIG. 2) is coupled to a rear face of back 130 (i.e., the side of back 130 facing a direction opposite of seat 120). Handle 275 enables a user (e.g., a technician) to move chair 100 from a first position to a second, desired position. In some implementations, handle 275 is ergonomically configured and/or oriented. For example, in one implementation, handle 275 is angled such that a hand palm faces downward and towards a centerline of chair 100 when the user grabs handle 275.

In some implementations, chair 100 includes at least one armrest 280 that includes an upper portion 290 and a lower portion 300 extending from upper portion 290. In some implementations, upper portion 290 is coupled to a middle portion 310 of back 130, and lower portion 300 is coupled to a middle portion 320 of seat 120.

In some implementations, armrests 280 are positioned such that a user may comfortably sit on seat 120. In some implementations, upper portion 290 is positioned and/or is at a height (relative to seat 120) that enables a user to rest an elbow on armrest 280 or, more particularly, upper portion 290, and/or enables chair 100 to be positioned adjacent an ophthalmic instrument and/or another object. In at least some implementations, armrest 280 is shortened and/or truncated to enable chair 100 to be positioned adjacent an ophthalmic instrument and/or another object without armrest 280 bumping into the ophthalmic instrument and/or table.

In some implementations, upper portion 290 and/or lower portion 300 extend laterally outward from back 130 and seat 120, respectively. In at least some implementations, a distance 340 (shown in FIG. 1) between armrests 280 is between approximately 24.5 and approximately 30.1 inches apart. More specifically, in at least one implementation, distance 340 is approximately 27.3 inches apart. Alternatively, upper portion 290 and/or lower portion 300 may extend from back 130 and/or seat 120, respectively, in any direction and/or have any orientation that enables chair 100 to function as described herein.

In some implementations, armrest 280 includes at least one portion (e.g., lower portion 300) that is angled and/or oriented such that the user may place a hand on armrest 280 to support him or herself while getting into and/or out of the chair. In at least one implementation, lower portion 300 is substantially parallel to the ground and/or base 110.

In some implementations, armrest 280 is at least partially fabricated from and/or coated with a chrome material and/or any other material that enables armrest 280 to be quickly and easily cleaned or sanitized between users.

During assembly, seat 120 is coupled to base 110, such that front portion 210 is positioned to the front of base 110, and rear portion 220 is positioned to the rear of base 110. In some implementations, seat 120 is coupled to base 110, such that seat 120 slopes downward towards front portion 210 and/or slopes upward towards rear portion 220. In at least some implementations, seat 120 is coupled to base 110, such that first seat angle 230 is substantially fixed between approximately 85 and approximately 90 degrees and/or such that second seat angle 240 is substantially fixed between approximately 90 and approximately 95 degrees.

In some implementations, back 130 is coupled to seat 120 and/or base 110, such that back 130 extends generally upward from rear portion 220 of seat 120. In at least some implementations, back 130 is coupled to seat 120 and/or base 110, such that back angle 250 is substantially fixed between approximately 93 and approximately 98 degrees. In at least some implementations, upper portion 290 of armrest 280 is coupled to middle portion 310 of back 130, and lower portion 300 of armrest 280 is coupled to front portion 210 of seat 120.

During use, in some implementations, a user sits in chair 100 and chair 100 is moved towards an ophthalmic instrument. In some implementations, armrest 280 is shortened or truncated to enable chair 100 to be positioned adjacent the ophthalmic instrument.

In some implementations, the user positions a user head within and/or adjacent to the ophthalmic instrument while seated within chair 100. More specifically, in at least some implementations, the ophthalmic instrument supports the user head, and chair 100 supports a user body. In some implementations, seat 120 slopes downward towards front portion 210, such that the user is able to comfortably maintain a neutral position during ophthalmic observation.

The implementations described herein relate to furniture. The implementations described herein enable a user to comfortably maintain a neutral position during ophthalmic observation. More specifically, the implementations described herein are configured and/or sized to accommodate a large population of users including an obese user, an elderly user, and/or a handicapped user. Additionally, the armrests are configured to enable the chair and/or the user to fit around a table and/or into testing equipment.

Some implementations of methods and systems for chairs are described above in detail. The methods and systems are not limited to the specific implementations described herein, but rather, components of systems and/or steps of the method may be utilized independently and separately from other components and/or steps described herein. Each method step and each component may also be used in combination with other method steps and/or components. Although specific features of various implementations may be shown in some drawings and not in others, this is for convenience only. Any feature of a drawing may be referenced and/or claimed in combination with any feature of any other drawing.

This written description uses examples to disclose the various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A chair comprising:

a base that defines a vertical axis;

a seat coupled to the base, the seat comprising a front portion positioned on a first side of the base, and a rear portion positioned on a second side of the base, wherein the seat is oriented along a plane that slopes downward from the rear portion to the front portion at a seat angle of between 86 degrees and 88 degrees relative to the vertical axis at the front portion of the seat to facilitate supporting a user in a neutral position and to enable the user to lean forward during an ophthalmic observation, the seat is coupled such that the seat angle is not adjustable; and a back coupled to at least one of the seat and the base, the back extending generally upward from the rear portion of the seat.

2. A chair in accordance with claim 1, wherein the base comprises an adjusting mechanism by which a height of the seat is adjustable.

3. A chair in accordance with claim 1, wherein the seat has a width and wherein the base has a width that is substantially greater than the width of the seat.

4. A chair in accordance with claim 1, wherein a base span of the base is defined as a region within which the base is configured to contact a floor during use of the chair, and wherein a depth between a front edge and a rear edge of the seat is no less than 70 percent of the base span.

5. A chair in accordance with claim 1, wherein the seat has a depth and a width that is greater than the depth.

6. A chair in accordance with claim 1, wherein the back and the seat define a back angle that is substantially fixed between 93 degrees and 98 degrees.

7. A chair in accordance with claim 1, wherein the back and the seat define a back angle that is not adjustable.

8. A chair in accordance with claim 1, wherein the back has a height and a width that is greater than the height.

9. A chair in accordance with claim 1 wherein the seat comprises a middle portion between the front portion and the rear portion, the chair further comprising an armrest that comprises an upper portion and a lower portion extending from the upper portion, wherein the lower portion is coupled to the middle portion of the seat.

10. A chair in accordance with claim 9, wherein the upper portion has a length and the lower portion has a length that is greater than the length of the upper portion.

11. A chair in accordance with claim 1 further comprising at least one handle coupled to the back.

12. A method of assembling a chair, said method comprising:

coupling a seat to a base, such that a front portion of the seat is positioned on a first side of the base, and a rear portion of the seat is positioned on a second side of the base, wherein the base defines a vertical axis, wherein the seat is oriented along a plane that slopes downward from the rear portion to the front portion at a seat angle of between 86 degrees and 88 degrees relative to the vertical axis at the front portion of the seat to facilitate supporting a user in a neutral position and to enable the user to lean forward during an ophthalmic observation, the seat is coupled such that the seat angle is not adjustable; and coupling a back to at least one of the seat and the base, the back extending generally upward from the rear portion of the seat.

13. A method in accordance with claim 12 further comprising coupling at least one handle to the back.

14. A method in accordance with claim 12, wherein coupling the back to the at least one of the seat and the base further comprises coupling the back such that a back angle defined between the back and the seat is substantially fixed between 93 degrees and 98 degrees.

15. A method in accordance with claim 12, wherein coupling the back to the at least one of the seat and the base further comprises coupling the back such that a back angle defined between the back and the seat is not adjustable.

16. A method in accordance with claim 12 further comprising coupling a lower portion of an armrest to the seat.

17. A method in accordance with claim 16 further comprising coupling an upper portion of the armrest to the back.

* * * * *